US005547443A

United States Patent [19]

Chen

[11] Patent Number: 5,547,443

[45] Date of Patent: Aug. 20, 1996

[54] ROCKING EXERCISE DEVICE WITH TWO SEATS

[76] Inventor: David Chen, 5Fl., No. 412–12, 2 Sec. Chung Shan Rd., Tai Ping, Taichung, Taiwan

[21] Appl. No.: 524,879

[22] Filed: Sep. 7, 1995

[51] Int. Cl.[6] ..... A63B 21/04

[52] U.S. Cl. ..... 482/72; 482/96; 482/121; 482/123

[58] Field of Search ..... 482/72, 95, 96, 482/121, 122, 123, 132; 472/108, 112, 124, 125, 120, 135

[56] References Cited

U.S. PATENT DOCUMENTS

| | | | |
|---|---|---|---|
| 2,699,201 | 1/1955 | Levy | 472/125 |
| 3,380,737 | 4/1968 | Elia et al. | 482/72 |
| 4,582,320 | 4/1986 | Shaw | 482/130 |
| 4,919,416 | 4/1990 | De Cloux | 482/57 |
| 5,423,731 | 6/1995 | Chen | 482/96 |

*Primary Examiner*—Lynne A. Reichard

[57] ABSTRACT

A rocking exercise device with two seats includes a base body consisting of a plurality of rods erected into a substantially triangular frame, an upstanding post pivotally connected to a central portion of the base body, with a pair of handlebars mounted at an upper portion thereof and a pair of foot rests mounted at a lower portion thereof; an extendible resilient member having an upper end portion thereof pivotally connected to the lower portion of the upstanding post and a lower end portion thereof pivotally connected to a horizontal rod of the base body, a pair of seats located opposite to each other and supported on cantilever beams pivotally joined to the lateral sides of the triangular frame of the base body, the seats further having cushions mounted thereon, and a pair of linkages each of which having two ends respectively connected pivotally to the upstanding post and the cantilever beams. The base body is mounted on a curved frame, which has a center of curvature in alignment with a perpendicular central line of the base body. Both ends of the curved frame are elevated from the floor. Legs are detachable mounted on the ends of the curved frame to provide firm support for the ends on the floor.

1 Claim, 3 Drawing Sheets

ROCKING EXERCISE DEVICE WITH TWO SEATS

BACKGROUND OF THE INVENTION

1. Field of the Invention

The present invention relates generally to an exercise device, and more particularly to a rocking exercise device with two seats, which is directed to improve the exercise device disclosed in U.S. patent application No. 08/253,310 (U.S. Pat. No. 5,423,731) by the present inventor.

2. Description of the Prior Art

Exercising is a major concern for modern people who are becoming more aware of the importance of health and physical fitness. However, not every one can afford to have the time to visit stadiums or physical fitness centers. Therefore, indoor exercise apparatuses or devices become increasingly popular. But these exercise devices, such as exercise bikes and exercise hikers are designed for use by only a single person, who may easily feel bored and lonely after some time. U.S. patent application No. 08/253,310 (U.S. Pat. No. 5,423,373) by the inventor has provided a breakthrough in conventional exercise devices, and the present invention is directed to provide a rocking exercise device with two seats to enhance the fun as well as the effects in exercising.

SUMMARY OF THE INVENTION

A primary object of the present invention is to provide a rocking exercise device with two seats for use by two people for enhancing the effects and fun of exercising using the rocking exercise device according to the present invention.

In order to achieve the above-mentioned object, the rocking exercise device with two seats according to the present invention comprises a base body consisting of a plurality of rods assembled into a substantially upright triangular frame; an upstanding post pivotally mounted to a cental portion of the base body, the upstanding post having a pair of handlebars mounted at an upper portion thereof, and a pair of foot rests mounted at a lower portion thereof; a resilient means disposed between the lower portion of the upstanding post and a horizontal rod of the base body and being extendible when an external force is applied thereon; a pair of seats supported by a pair of cantilever beams and pivotally joined to both sides of the triangular frame of the base body, the seats being provided with cushions for comfortable sitting; and a pair of linkages, each of which has one end pivotally connected to its corresponding handlebar and cantilever beam supporting the seat.

The present invention is characterized in that the base body is securely mounted on a curved frame structure with a pre-determined curvature, the center of the curved frame structure aligns with a perpendicular central line of the base body with both ends of the curved frame structure elevated at equal distance from the floor. The bottom sides of the two ends of the curved frame structure are respectively provided with legs which are detachable therefrom for supporting and positioning the two ends thereof. By this arrangement, the users may determine whether or not to assemble the legs to the curved frame and may enjoy greater exercising effects and fun in manipulating the present invention.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
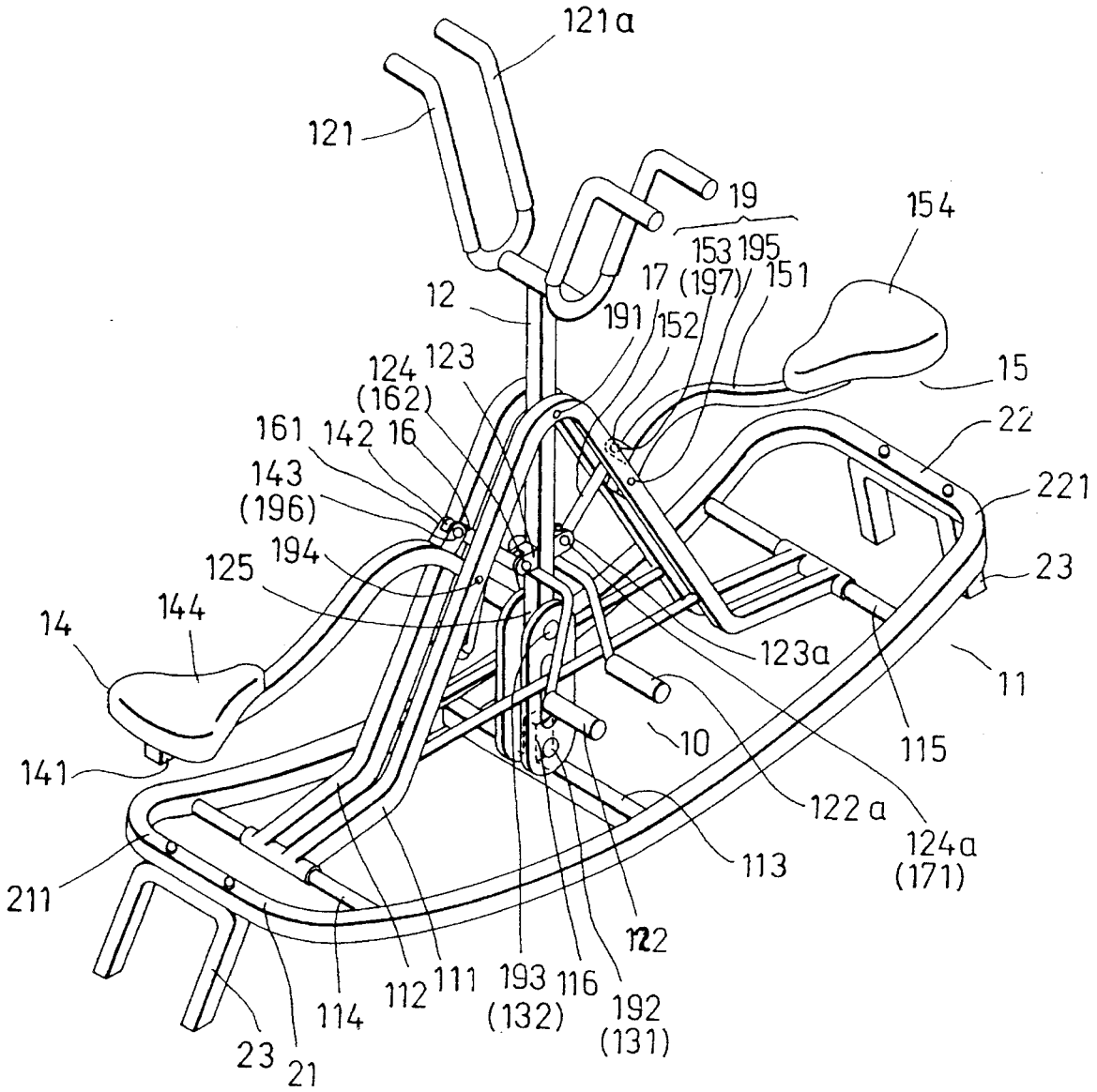
FIG. 1 is a perspective view of a first preferred embodiment of the rocking exercise device according to the present invention.

With reference to FIG. 1, a rocking exercise device 10 according to the present invention essentially comprises a base body 11, an upstanding post 12, a resilient means 13, a pair of seats 14, 15, a pair of linkages 16, 17, and connecting elements 19.

Figure 2:
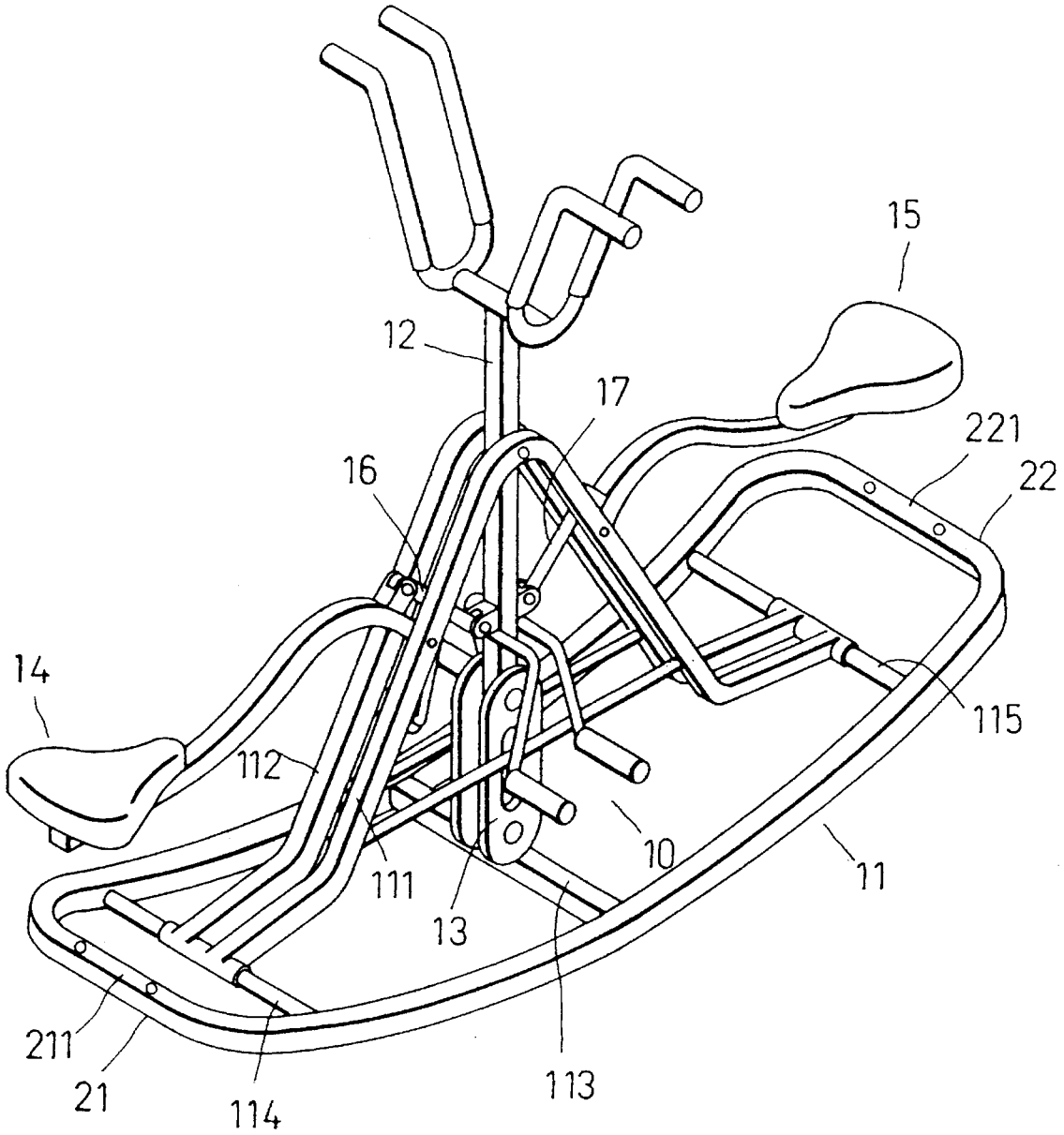
FIG. 2 is a perspective view of a second preferred embodiment of the rocking exercise device according to the present invention.
Figure 4:
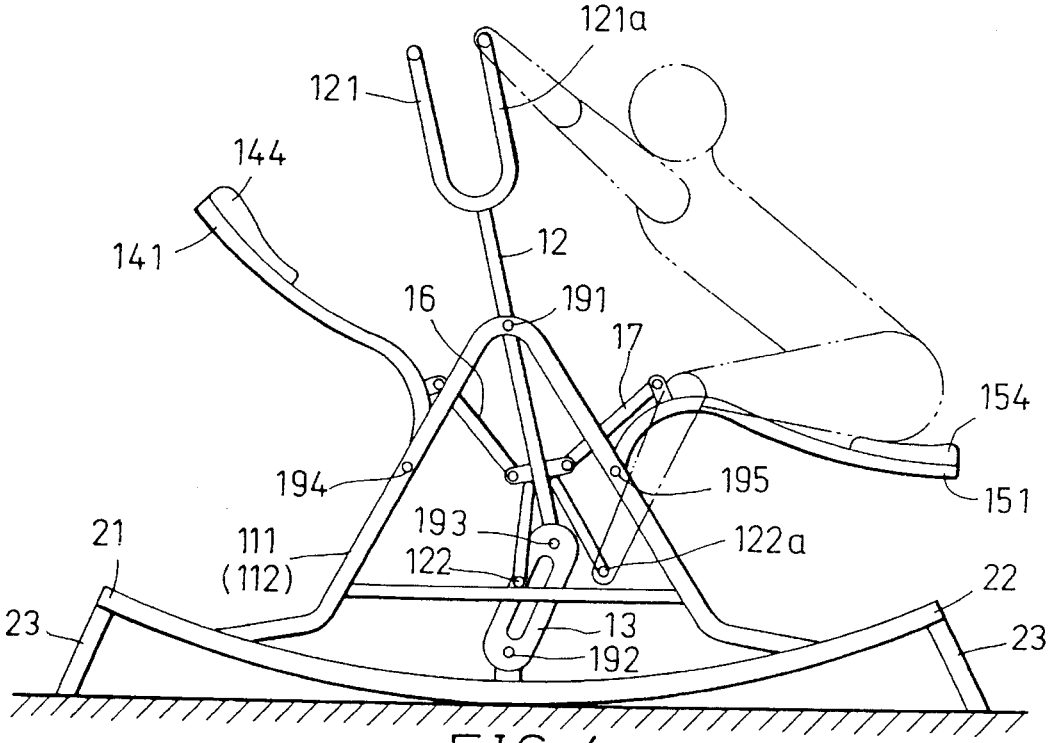
FIG. 4 is a plan schematic view of the first preferred embodiment of the rocking exercise device according to the present invention.

The base body 11 consists of two A-shaped rods 111, 112, a horizontal rod 113, two cross pieces 114, 115, and a curved frame 20. The A-shaped rods are erected in a parallel relationship and are spaced apart from each other at a suitable distance. The horizontal rod 113 and the two cross pieces 114, 115 are respectively connected between the lateral sides of the curved frame 20 in a parallel relationship, with the horizontal rod 113 located in the middle separating the two cross pieces 114, 115. A pivoting portion 116 with holes is projectingly disposed at a middle portion of the horizontal rod 113. The curved frame 20 has a pre-determined curvature with both end portions 21, 22 elevated above the floor at a pre-determined distance. As shown in FIG. 4, a center C of the curvature of the curved frame 20 is in alignment with a perpendicular central line S of the base body 11, so that the A-shaped rods 111, 112 may be stably supported on the curved frame in a balanced manner. The two ends 21, 22 of the curved frame 20 are respectively provided with a couple of vertical through holes 211, 221 for receiving bolts 211A, 221A and nuts, which secure leg elements 23 to the two ends 21, 22 for supporting and positioning the two ends 21, 22. The leg elements 23, however, may be selectively detached from the curved frame 20 as desired by the users. FIG. 2 shows a preferred embodiment of the rocking exercise device withouth the leg elements 23.

The upstanding post 12 is located between the A-shaped rods 111, 112 with the connecting elements 191 passing through the apical portions of the A-shaped rods 111, 112, the connection being secured by C-clips. By this arrangment, the upstanding post 12 can be caused to swing back and forth. The handlebars 121, 121*a* are mounted at an upper portion of the upstanding post 12, while the foot rests 122, 122*a* are mounted at a lower portion thereof. The upper portions of the foot rests 122, 122*a* are provided respectively with lugs 123, 123*a* having a U-shaped cross section. The lugs 123, 123*a* are provided with holes 124, 124*a*. The lower end of the upstanding post 12 is provided with a connecting portion 125.

The resilient means 13 consists of two plate-like rubber springs facing each other. The upper and lower end portions of each rubber spring is semi-spherical in shape and having holes 131, 132. These holes 131, 132 correspond to a hole of the connecting portion 116 on the horizontal rod 113 of the base body 11 and a hole in the connecting portion 125 of the upstanding post 12. By means of connecting elements 192, 193 passing through the connecting portion 116 on the horizontal rod 113 of the base body 11 and the connecting portion 125 at the lower portion of the upstanding post 12 to permit pivotal movement, the connecting elements 192, 193 being positioned by C-clips, the resilient means 13 may be stretched leftwise or rightwise (of the Figure) with the back and forth movement of the upstanding post 12.

The seats 14, 15 are mounted opposite to each other and supported by the cantilever beams 141, 151, each of which is slightly bent and has a vertical end portion pivotally mounted between the lateral sides of the two A-shaped rods 111, 112 at a suitable position by means of connecting elements 194, 195. Lugs 142, 152 with respective holes 143, 153 each having a U-shaped cross section are respectively provided at a middle section of the cantilever beams 141, 151. Two cushions 144, 154 are respectively installed at the substantially horizontal end portion of the cantilever beams 141, 151 for supporting two people.

The linkages 16, 17 are respectively provided with holes 161, 162, 171, 172 at their either ends for matching the holes **124, 124*a* of the lugs 123, 123*a* on the upstanding post 12 and the holes 143, 153 of the lugs 142, 152 on the seats 14, 15. By means of connecting elements 196, 197 positioned by C-clips, pivotal movement of the linkages 16, 17** is permitted.

Figure 3:
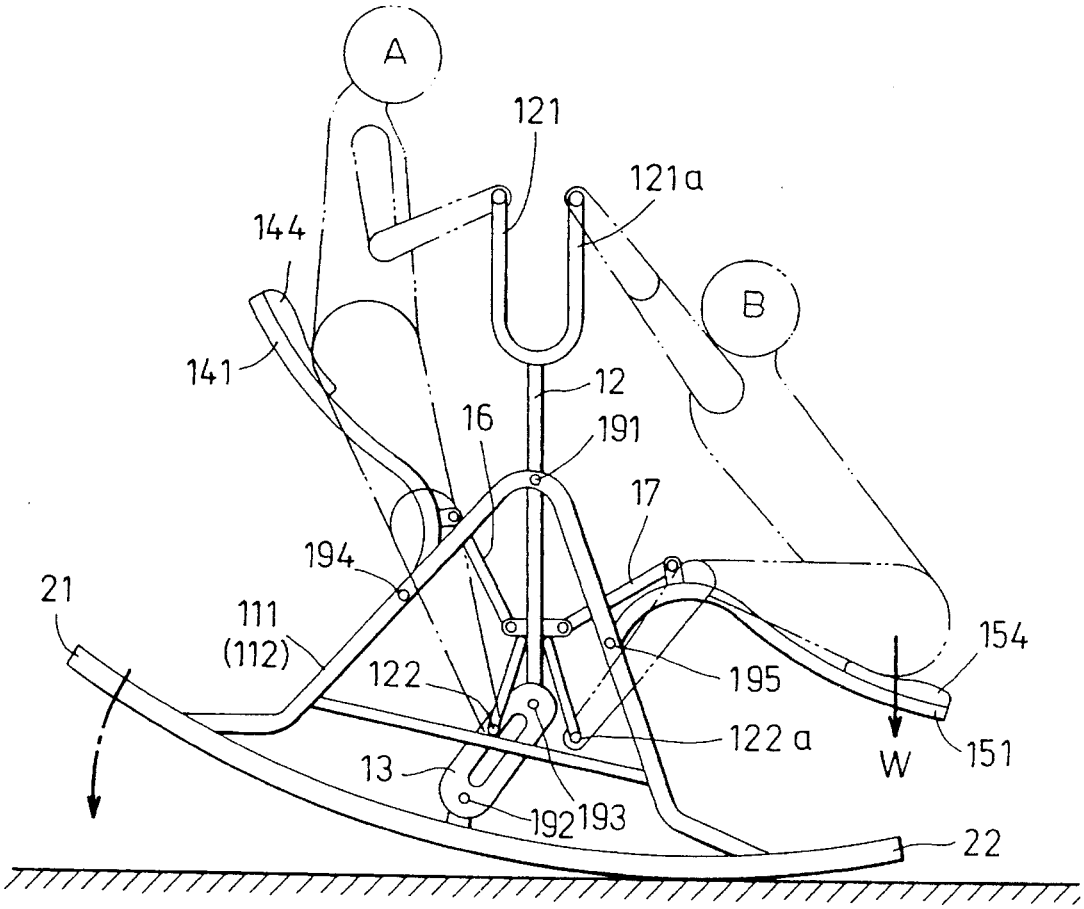
FIG. 3 is a plan schematic view of the second preferred embodiment of the rocking exercise device according to the present invention.

The rocking exercise device 10 according to the present invention is accomplished by assembly of the above-described components. Referring to FIG. 1 which shows a fixed-type exercise device with two seats, since leg elements 23 are provided to support the two ends 21, 22 of the curved frame 20 supporting the base body 11 mounted thereon, the exercise device may be firmly supported on the floor. In this manner, one or two persons may manipulate the exercise device by sitting on the seat(s) 14 (15) with both hands holding the handlebar(s) 121 (**121*a*) to perform stretching and retracting movements, as shown in FIG. 4. Such a feature has been disclosed in U.S. Pat. No. 08/253,310 (U.S. Pat. No. 5,423,731) by the inventor. Referring to FIG. 2 which shows the exercise device 10 without the legs 23, the two ends 21, 22 are elevated above the floor to permit rocking motion of the curved frame 20. FIG. 3 shows two people sitting on the seats 14, 15** on the left and right side (of the Figure).

When a person A sitting on the left side pushes the foot rest 122 forwardly, with both hands gripping the handlebar 121 and pulling it backwardly, the upper portion of the upstanding post 12 at this time will, with its pivotal point on the base body 11 as the center, incline to the left, while the lower portion thereof being oriented to the right, causing the resilient means 13 to stretch so that its upper portion inclined to the right, with the hole 132 at the lower portion thereof engaging the connecting portion 116 on the horizontal rod of the base body as the axis. Then the linkage 16 linked up with the upstanding post 12 will pull the cantilever beam 141 supporting the seat 14 to swing and displace upwardly with the piovtal joint of its end portion and the base body 11 as the axis. At this time, the person A will be in a standing position, and his/her leg muscles will be stretched, while his/her arms move backwardly to rest close against the body. For another person B sitting on the right, due to the inclination of the handlebar **121*a* at the upper end portion of the upstanding post 12 to the left, pushing the foot rest 122*a* to the right and the linkage 15 downwardly, bringing the seat 17 to swing and displace downwardly, his/her arm muscles as well as the trunk will be stretched, while both legs bending towards the body. In this manner, both persons A and B may stretch their arms and legs alternatively. However, since the two ends 21, 22 of the curved frame 20 are elevated above the floor without any support, the entire exercise device will rock back and forth like a rocking chair. As shown in FIG. 3, in addition to the alternate stretching movements provided by the exercise device of the present invention, when the person B sitting on the right exerts a force so that the person A is swung upwardly, the person B on the left will have to exert his/her own weight W downwardly in order to achieve balance. As a result, the side muscles of the body will be stretched and contracted to a great extent. Vice versa, the same effect will also be achieved. Hence, the present rocking exercise device provides enhanced exercising effects. More particularly, in rocking back and forth, both persons may enjoy the fun of sitting on rocking chairs. Moreover, in using the exercise device together, both persons have to bear the weight of the other in performing pushing or pulling actions, which further trains the muscles of the arms and the legs. When used at home, the present invention may also promote family harmony and encourage family participation. The present exercise device when used without the legs 23** may also be manipulated by a single person who, having no need to bear the weight of a seond participant, may operate the device with ease.

In view of the aforesaid, the rocking exercise device according to the present invention provides more variety in operation for use by two people. Users may not only exercise their body, arms and legs but also enjoy the fun in exercising with family members.

Although the present invention has been illustrated and described with reference to the preferred embodiment thereof, it should be understood that it is in no way limited to the details of such embodiment but is capable of numerous modifications within the scope of the appended claims.

What is claimed is:

1. A rocking exercise device with two seats comprising:

a base body consisting of a plurality of rods erected into a substantially triangular frame, an upstanding post pivotally connected to a central portion of said base body, a pair of handlebars being mounted on an upper portion thereof, and a pair of foot rests being mounted on a lower portion thereof;

a resilient means having an upper end portion pivotally connected to the lower portion of said upstanding post and a lower end portion pivotally connected to a horizontal bar of said base body, said resilient means being extendible when an external force is applied thereon;

a pair of seats located opposite to each other and supported on a pair of cantilever beams which are pivotally joined to the lateral sides of said base body, each of said seats having a cushion for supporting a user; and a pair of linkages each of which has an upper end thereof pivotally connected to said upstanding post and a lower end thereof pivotally connected to one of said cantilever beams of said seats, wherein said base body is mounted on a curved frame, said curved frame having a center of curvature in alignment with a perpendicular central line of said base body, said curved frame having two ends elevated above the floor, leg elements being detachable mounted onto the two ends of said curved frame for supporting and positioning the two ends.

* * * * *